United States Patent [19]

Thomas

[11] Patent Number: 4,687,169

[45] Date of Patent: Aug. 18, 1987

[54] PLATE HOLDER

[76] Inventor: James E. Thomas, 16W67 Timberview Dr., Oak Brook, Ill. 60521

[21] Appl. No.: 887,743

[22] Filed: Jul. 21, 1986

[51] Int. Cl.[4] ..... A47G 1/16

[52] U.S. Cl. ..... 248/490; 211/41; 248/1

[58] Field of Search ..... 248/490, 491, 488, 916, 248/359.1, 489, 359 F, 359 R, 903; 211/41

[56] References Cited

U.S. PATENT DOCUMENTS

| | | | |
|---|---|---|---|
| 213,264 | 3/1879 | Vizet | 248/490 |
| 572,368 | 12/1896 | Porter | 248/916 X |
| 806,321 | 12/1905 | Clark | 248/490 |
| 1,022,090 | 4/1912 | Kasindorf | 248/488 X |
| 1,760,153 | 5/1930 | Luce, Jr. | 248/359.1 |
| 1,879,403 | 9/1932 | Monroe | 248/488 |
| 2,315,268 | 3/1943 | Oliphant | 248/490 |
| 2,365,108 | 12/1944 | Richards | 248/490 |
| 2,632,971 | 3/1953 | Manczek et al. | 248/491 X |
| 3,001,748 | 9/1961 | Austin | 248/488 X |
| 3,074,680 | 1/1963 | Stewart | 248/489 X |
| 3,384,987 | 5/1968 | Prechtl | 248/489 |
| 3,740,016 | 6/1973 | Buescher | 248/488 |
| 4,473,207 | 9/1984 | Nascher | 248/490 |

FOREIGN PATENT DOCUMENTS

| | | | |
|---|---|---|---|
| 60127 | 11/1968 | German Democratic Rep. | 248/488 |

*Primary Examiner*—J. Franklin Foss
*Assistant Examiner*—David L. Talbott
*Attorney, Agent, or Firm*—Richard W. Carpenter

[57] ABSTRACT

A unitary, molded plastic device for holding and displaying a decorative article, such as a plate, from a vertical surface, such as a wall, which holder includes an annular body member having projecting radially outward therefrom three support members that include hook elements, for engaging and holding said plate, and positioning elements, for spacing said holder from a wall on which said holder is supported.

10 Claims, 5 Drawing Figures

PLATE HOLDER

BACKGROUND OF THE INVENTION

1. Field of the Invention

This invention relates generally to display devices and more particularly to a device for holding and displaying a decorative article, such as a plate, from a vertical surface, such as a wall.

2. Description of the Prior Art

A prior art search directed to the subject matter of this application in the United States Patent and Trademark Office revealed the following U.S. Pat. Nos.: 213,264; 806,321; 1,022,090; 2,315,268; 2,365,108; 2,632,971; 3,001,748; 3,074,680; 3,740,016.

None of the prior art patents uncovered in the search discloses a holding device comprising a generally flat annular ring having a plurality of flanges projecting therefrom, each of which includes a hook element, for holding a portion of the plate, and a positioning element, for maintaining the portion holder and the plate in proper position with respect to the wall on which the device is supported.

SUMMARY OF THE INVENTION

It is an object of the present invention to provide a holding device for displaying a decorative article, such as a plate or a plaque, from a vertical, surface such as a wall.

Another object of the invention is the provision of a one piece holding device which may be formed from molded plastic material.

A more specific object of the invention is the provision, of a device of the type described, comprising an annular ring having projecting therefrom a plurality of flanges each of which has a hook extending from the front thereof for holding a portion of the plate and a positioning element extending from the rear side thereof for engagement with the wall to maintain the holder and plate in a proper position.

These and other objects of the invention will be apparent from an examination of the following description and drawings.

It will be understood that, for purposes of clarity, certain elements may have been intentionally omitted from certain views where they are believed to be illustrated to better advantage in other view.

DESCRIPTION OF THE PREFERRED EMBODIMENT

Figure 1:
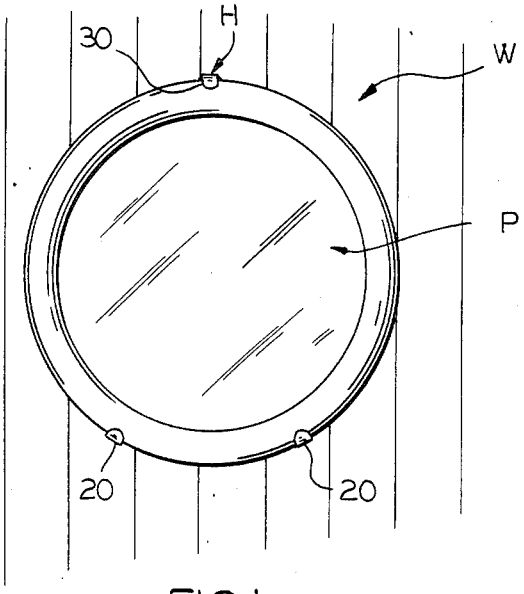
FIG. 1 is a fragmentary side elevational view of a plate holder embodying features of the invention, shown holding a plate against a vertical surface, such as a wall.

Referring now to the drawings for a better understanding of the invention, it will be seen that there is illustrated in FIG. 1 a plate holding device, indicated generally at H, and embodying features of the invention, which is shown to be holding a decorative article, such as a plate P, and supporting the plate P from a vertical surface, such as a wall W.

Figure 2:
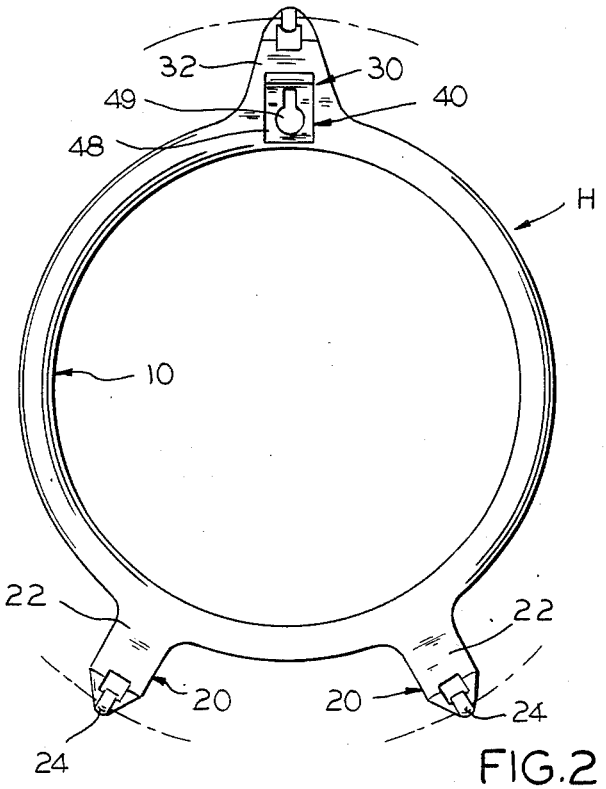
FIGS. 2 and 3 are fragmentary front and rear side elevational views, respectively, of the holder illustrated in FIG. 1.
Figure 3:
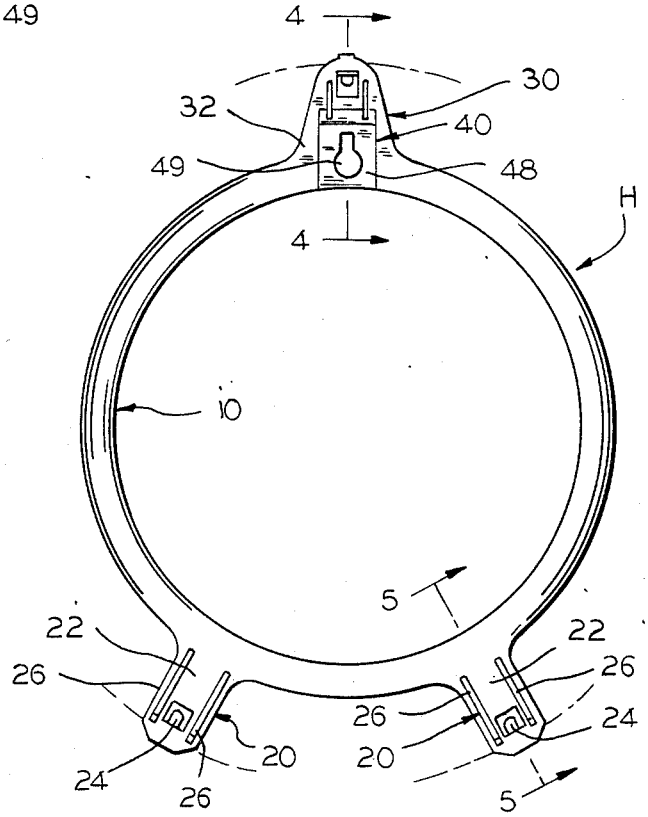

As best seen in FIGS. 2 and 3, the holder H includes a generally flat, annular body member 10 having an upper plate support member 30 formed integrally therewith and projecting radially upward therefrom, and having a pair of lower plate support members 20 formed integrally therewith and projecting radially downward therefrom.

Each of the lower plate support members 20 includes a generally flat flange 22 having at its outer periphery a hook element 24 extending forwardly therefrom. Each of the hook elements 24 includes a first element 24*a*, a second element 24*b*, and a third element 24*c*, which cooperate with the front surface of the flange 22 to form a recess 25 for receiving and supporting a peripheral portion of the held article such as plate P.

Figure 5:
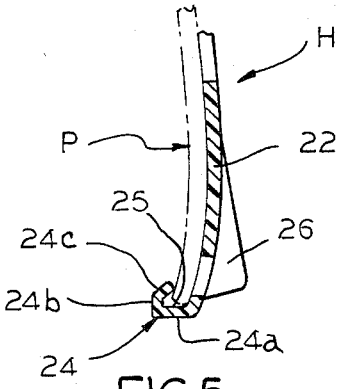

Extending rearwardly from the flange 22 are a pair of spaced ribs 26 which, as best seen in FIG. 5, serve to space the plate forwardly from the wall on which the holder is supported to maintain it in a desired vertical position with respect to the wall.

Figure 4:
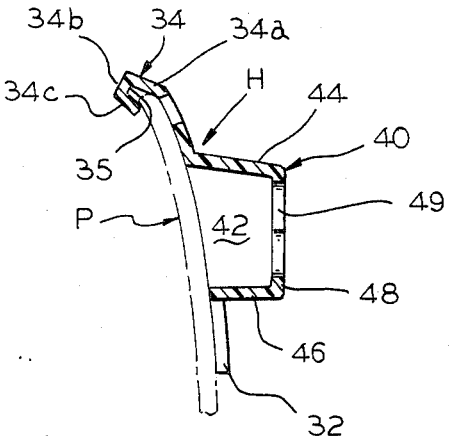
FIGS. 4 and 5 are fragmentary sectional views taken on lines 4—4 and 5—5, respectively, of FIG. 3.

Still referring to FIGS. 2 and 3, and also to FIG. 4, it will be seen that the upper plate support member 30 includes a a flange 32 projecting radially outward from the member 10.

Flange 32 has a hook element 34 comprising portions 34*a*, 34*b*, and 34*c* extending forwardly from its outer extremity to define with the flange a recess 35 for holding and engaging another peripheral portion of a decorative article such as plate P.

Upper plate support number 30 also includes a positioning and hanger member, indicated generally at 40, which comprises a pair of side panels 42, an upper panel 44, a lower panel 46, and a rear panel 48. These panels are formed integrally with each other to provide a generally box-like structure which serves to position the upper portion of the holder in proper spaced relation forwardly from the wall on which it is supported. Upper panel 44 extends rearward from the rear surface of the flange 32, and is also joined to the flange by a pair of spaced ribs 36, which strengthen the connection betweem the flange and the supporting member 40.

In order to hang the device from a nail or hook on the wall there is provided a keyhole slot extending through rear panel 48 of hanger member 40.

Thus, it should be appreciated that the invention comprises a plate or plaque holding device of relatively simple design and inexpensive construction which may be easily formed by molding plastic material. The device is adapted to hold edge portions of a plate to maintain it in position on a wall for decorative purposes and also to space the plate outwardly from the wall, so that it maintains a proper vertical position at all times.

What is claimed is:

1. A unitary, molded plastic holder for supporting and displaying against a vertical surface, such as a wall, a decorative article, such as a plate, said holder comprising:

(a) a relatively thin flat body member in the form of a narrow ring having:

(i) an integral, upper support member projecting radially upward therefrom;

(ii) a pair of integral, lower support members projecting radially downward therefrom;

(b) each of said support members including:

(i) a flange;

(ii) a relatively flexible hook element extending forwardly from said flange and cooperating therewith to receive and retain an edge portion of said article;

(iii) a positioning element extending rearwardly from said flange for engaging said vertical surface and spacing said holder forwardly thereof and generally parallel thereto;

(c) said upper support member also including means for supporting said holder from said vertical surface.

2. A holder according to claim 1, wherein said positioning element includes at least one rib disposed extend normal to said flange.

3. A holder according to claim 1, wherein said positioning element includes a pair of ribs spaced laterally from each other and disposed extend normal to said flange.

4. A holder according to claim 1, wherein said positioning element is a hollow box-like structure aligned with said body member.

5. A holder according to claim 1, wherein said positioning element of said upper support member is a hollow box-like structure containing an aperture for supporting said holder from said vertical surface.

6. A holder according to claim 1, wherein said positioning elements of said lower support members each includes a pair of spaced ribs and where the positioning element of said upper support member includes a hollow box-like structure having top, bottom, rear and side panels.

7. A holder according to claim 1, wherein said upper support member means for supporting said holder from said vertical surface comprises a keyhole shaped opening in the positioning element of said upper support member.

8. A holder according to claim 1, wherein said hook elements are spaced radially outwardly and forwardly from said body member.

9. A unitary, molded plastic holder for supporting and displaying against a vertical surface, such as a wall, a decorative article, such as a plate, said holder comprising:

(a) a thin flat body member in the form of a narrow ring having:

(i) an integral, upper support member projecting radially upward therefrom;

(ii) a pair of integral, lower support members projecting radially downward therefrom;

(b) each of said support members including:

(i) a relatively flexible hook element extending forwardly and adapted to receive and retain an edge portion of said article;

(ii) a positioning element extending rearwardly for engaging said vertical surface and spacing said holder forwardly thereof and generally parallel thereto;

(c) said upper support member also including means for supporting said holder from said vertical surface.

10. A unitary, molded plastic holder for supporting and displaying against a vertical surface, such as a wall, a decorative article, such as a plate, said holder comprising:

(a) a thin flat body member in the form of a narrow ring having:

(i) an integral, upper support member projecting radially upward therefrom;

(ii) a pair of integral, lower support members projecting radially downward therefrom;

(b) each of said support members including:

(i) a relatively flexible hook element adapted to receive and retain an edge portion of said article;

(iii) a positioning element for engaging said vertical surface and spacing said holder forwardly thereof and generally parallel thereto;

(c) said upper support member also including means for supporting said holder from said vertical surface.

* * * * *